US006425681B1

(12) United States Patent
Agabekov

(10) Patent No.: US 6,425,681 B1
(45) Date of Patent: Jul. 30, 2002

(54) LIGHT RAMP

(76) Inventor: Branka Agabekov, 73, route de Thonon, CH-1222 Vésenaz (CH)

( * ) Notice: Subject to any disclaimer, the term of this patent is extended or adjusted under 35 U.S.C. 154(b) by 0 days.

(21) Appl. No.: 09/486,630

(22) PCT Filed: Sep. 1, 1997

(86) PCT No.: PCT/CH97/00317

§ 371 (c)(1),
(2), (4) Date: May 30, 2000

(87) PCT Pub. No.: WO99/11970

PCT Pub. Date: Mar. 11, 1999

(51) Int. Cl.[7] ..... F21V 17/10

(52) U.S. Cl. ..... 362/375; 362/223; 362/368; 362/362

(58) Field of Search ..... 362/217, 220–223, 362/362, 368, 374, 375

(56) References Cited

U.S. PATENT DOCUMENTS

| | | | | |
|---|---|---|---|---|
| 5,479,327 A | | 12/1995 | Chen | 362/222 |
| 5,541,823 A | | 7/1996 | Fallon et al. | 362/219 |
| 5,702,176 A | * | 12/1997 | Engle | 362/221 |
| 5,791,764 A | * | 8/1998 | Jaksich | 362/222 |
| 5,803,588 A | * | 9/1998 | Costa | 362/223 |
| 5,823,663 A | * | 10/1998 | Bell et al. | 362/362 |
| 6,050,700 A | * | 4/2000 | Satterfield | 362/217 |

FOREIGN PATENT DOCUMENTS

| | | |
|---|---|---|
| DE | 1071229 | 12/1959 |
| EP | 0142432 | 5/1985 |
| EP | 00652398 | 5/1995 |

* cited by examiner

*Primary Examiner*—Alan Cariaso
(74) *Attorney, Agent, or Firm*—Ostrolenk, Faber, Gerb & Soffen, LLP

(57) ABSTRACT

The invention concerns a light ramp (1) comprising a base section (2) with two side wings and including at least: a transparent plastic section (3) in the longitudinal direction with two edges co-operating with the base section (2) side wings so as to completely cover them by enclosing them; and two aluminium covers (4) located at the ramp (1) ends so as to enclose the transparent section (3) and the base section (2) wing ends.

15 Claims, 2 Drawing Sheets

LIGHT RAMP

The present invention relates to the field of lighting and more particularly to a light fitting.

U.S. Pat. No. 5,541,823 proposes a light fitting for protecting and supporting neon-type light tubes, which comprises a base section, a central section and a transparent cover section with covers at the ends, to be used both indoors and outdoors.

The subject of Patent EP-A-0,142,432 is a closed luminaire containing fluorescent tubes, which is composed in particular of a body, a diffuser and two endpieces, as well as means for providing a seal between the body, the diffuser and the endpieces. The endpieces carry the sockets for the tubes and, optionally, an ignition device.

The filing company has already developed an electrical supply rail, described in European Patent Application EP-0,375,623, which relates to a light fitting and has a succession of pairs of electrical contacts comprising at least two superposed conducting strips having, at predetermined distances, contact pads arranged at 90° in order to supply series of bulbs placed between two adjacent contacts. The conducting strips are each covered with a continuous insulating body over their entire surface, so as to form a stack in which the conducting strips are completely insulated from each other and from the outside, excluding the contact pads.

In its European Patent Application EP-516,578, the filing company has proposed that the conducting strips be slid into a section having a central recess for the conducting strips and an opening allowing the contact pads to pass freely.

In European Patent Application EP-0,652,398, the filing company has proposed an aluminum reflector of parabolic cross section, lying in a continuous manner inside the section along its length direction and the electrical contact pads pass through said reflector, so that the focus of the parabolic reflector lies close to the center of the bulbs, so as to form a linear reflector distributing a narrow light beam over the entire length of said fitting, and to allow the insertion of a diffusing grid placed in said light beam and capable of directing it and reflecting it in a preferred direction.

The present invention relates to an improvement intended more particularly to lighting when, for practical reasons, the fitting has to be situated such that the beam is directed upward without there being any possibility for the fitting to be protected and is consequently exposed to the weather. To alleviate this drawback, fittings like the one proposed in this Invention must be provided.

According to the invention, the light fitting comprises a base section having two lateral flanges and an electrical supply rail placed inside the base section, a transparent plastic section applied against the lateral flanges of the base section and two covers which are capable of engaging with the base section and the transparent section and are placed at the ends of the light fitting. It is one in which the transparent section made of plastic is cut to a length slightly greater than that of the base section and has lateral edges which completely cover, by surrounding them, the upper ends of the flanges of the base section, the transparent section resting at the two ends of the fitting on the upper edge of a closure endpiece fastened to the base section, the two end covers being pressed against the endpiece and enclosing the transparent section and the upper edges of the base section.

It is advantageously provided with two lateral sections which are placed in the length direction, each covering a lateral edge of the transparent plastic section over its entire length. The lateral sections each have a rounded slideway which is slipped into rounded slots in the base section so as to remain fixed over the entire length of the fitting, the free end of each section being designed to press the transparent plastic against the edge of the base section and to hold it in place laterally.

In a preferred embodiment, the transparent plastic section, made of a polycarbonate or if necessary an acrylic material, is an extruded plastic. Likewise, the two aluminum sections are also extruded. This embodiment makes it possible to devise fittings of variable length which may range up to 300 cm.

In this embodiment, the aluminum covers of the fitting leave a free space at the ends of the fitting so that the transparent plastic and the aluminum sections, which are slightly longer than the base section, can vary in length because of the expansion and contraction of the materials with the variations in temperature.

The fitting may advantageously have holes in its lower part so as to be able to drain off the water produced by condensation from its interior.

In a preferred embodiment, at least one of the upper edges of the base section terminates in an inclined shape in order to make it easier to fit the transparent plastic section. The closure endpieces are positioned relative to the base section using pins, the covers covering the endpieces and being fastened by means of screws screwed into the boreholes in the base section. The base section has a lug and a groove allowing the fitting to be fastened to a fastening member by a simple clip-in system.

The fitting is advantageously designed to contain, inside it, a parabolic reflector which concentrates the light beam in one direction. It may contain, inside it, at least one diffusing grid in order to prevent the light from being reflected in undesirable directions.

The appended drawing illustrates, by way of nonlimiting example, one embodiment of the subject of the present invention.

Figure 1:
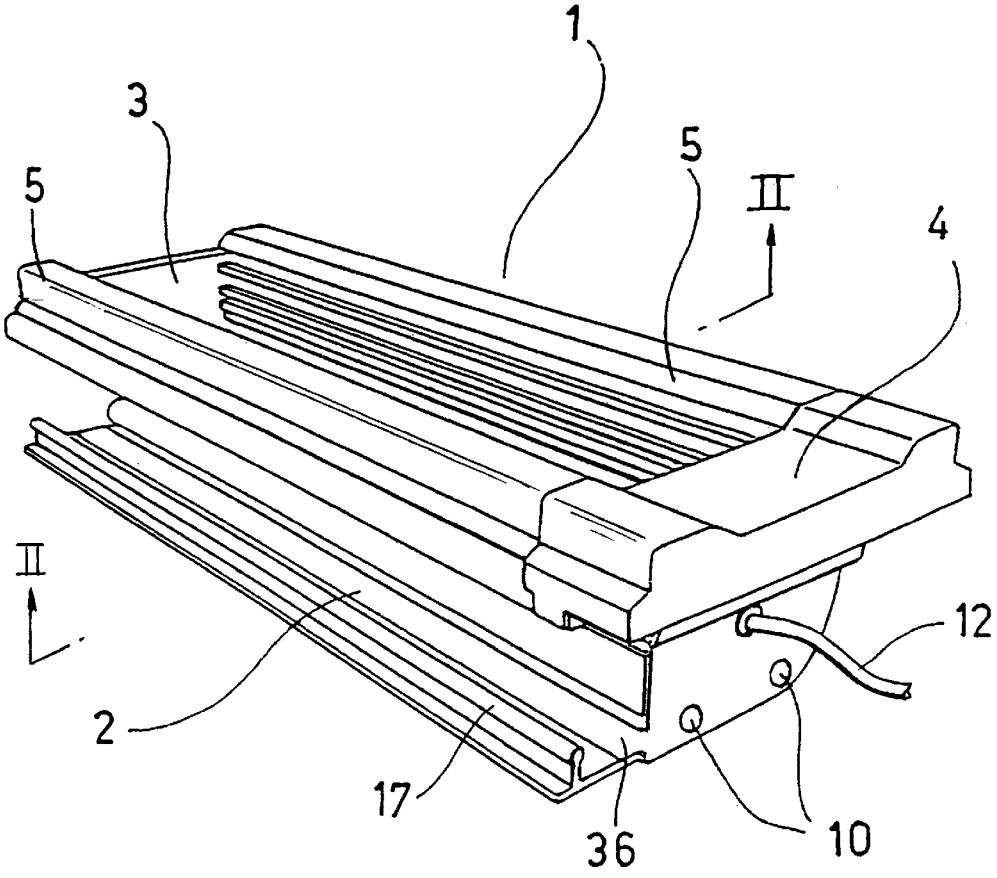
FIG. 1 is a general perspective illustration of a light fitting.
Figure 2:
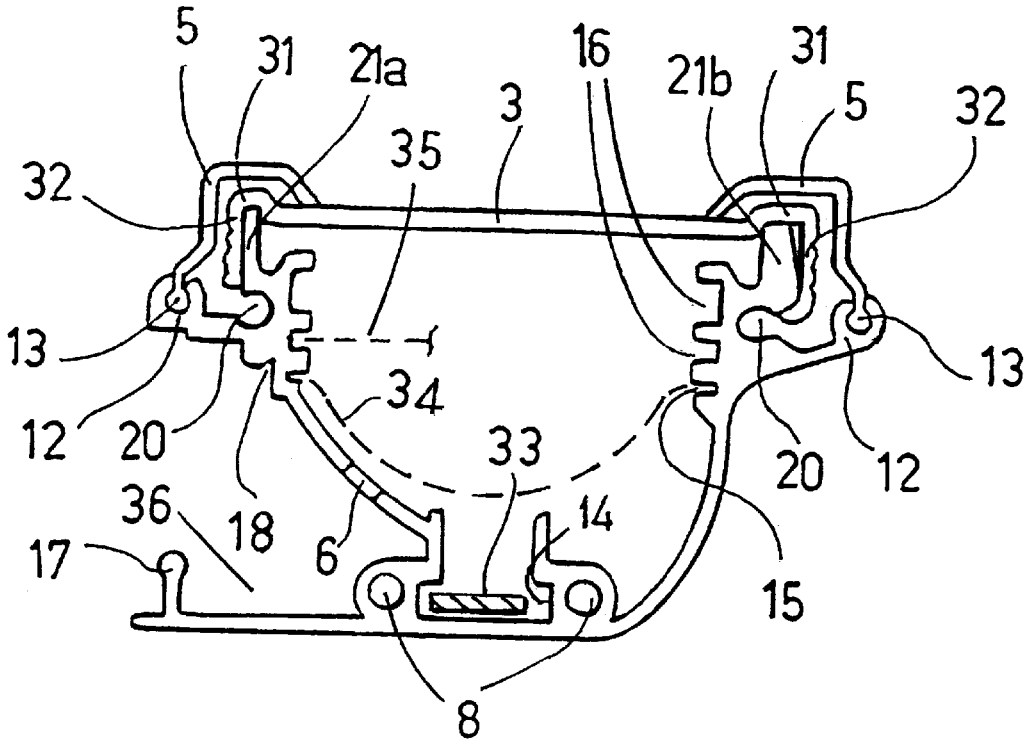
FIG. 2 is a cross section through the light fitting in FIG. 1, on the line II—II.
Figure 3:
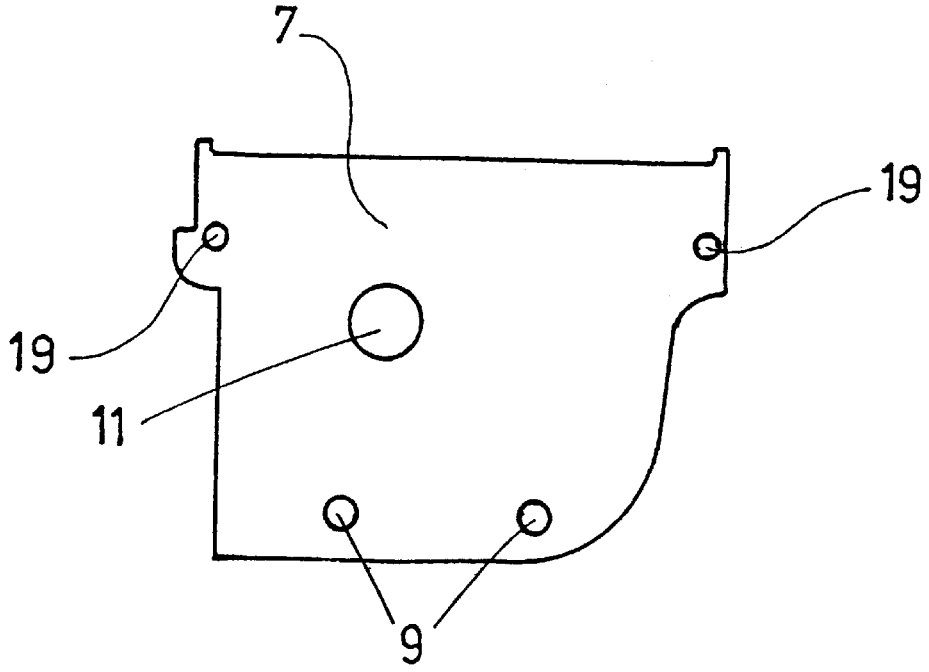
FIG. 3 is a detailed illustration of the closure endpiece to be placed at the end of the fitting, just inside the aluminum cover.

In the general illustration in FIG. 1, the light fitting 1 is composed of a base section 2, a plastic section 3, an aluminum cover 4, placed at each end of the fitting 1, and two aluminum sections 5. Shown in FIG. 2 is one of the holes 6 which allow the water produced by condensation inside the fitting to be drained off. FIG. 3 shows a closure endpiece 7 with the hole 11 for a conducting flex 12 as well as the holes 9 for the fastening screws 10. The electrical supply rail and the parabolic reflector are not illustrated for the sake of simplifying the drawing.

As shown in the drawing, the aluminum cover 4 has an upper part, which exceeds the length of the base section 2, as well as the aluminum sections 5, so as to allow the transparent plastic section 3 to expand due to variations in temperature when the light fitting 1 is turned on.

The transparent plastic section 3 in one advantageous embodiment is manufactured by extruding transparent polycarbonate, of the MACROLON or PLEXIGLAS type; this allows the dimensions of the fitting to be varied so that it is possible to go from very short lengths up to lengths of 300 cm. It includes a central part with edges 31 which engage with the upper ends 21*a*, 21*b* of the base section 2, in order to end up with two flanges 32 which partially surround said ends 21*a*, 21*b*. The outer face of the flanges has grooves so that it fits together better with the other surfaces when the transparent section is subjected to the expansion and contraction effects.

The aluminum sections 5 may also be manufactured by extrusion and adapted to the same dimensions as the transparent plastic section 3. These aluminum sections 5 terminate in rounded slideways 13 which engage with the rounded slots 12 in the base section 2, so as to be slipped into their interiors and to remain fastened along the entire length of the fitting. The aluminum sections 5 press the plastic section 3 against the edges of the base section 2 and hold it in place laterally. Consequently, the aluminum sections 5 prevent any deformation of the plastic section 3.

In the lower part of the base section 2, it will be advantageous for there to be holes 6, placed at regular intervals, which allow the water of condensation that has accumulated in the fitting to be drained off. This base section 2 allows the insertion of an electrical supply rail into it and to do so it has, in its lower part, a widened region 14 for housing said rail (which is not illustrated in the drawing). Likewise, the grooves 15 serve for a parabolic reflector (not illustrated) to be slid in, so as to transmit a light beam concentrated in a precise direction. Advantageously, the grooves 16 serve or placing one or more diffusing grids (not illustrated) so as to prevent the light from being reflected undesirably. One of the flanges 21*b* of the base section has an outer rim which is inclined in order to make it easier for the transparent plastic section 3 to be fitted.

A lug 17 and a special groove in the part 16 allow the fitting 1 to be fastened to a support (not illustrated) of a fastening piece by means of a simple clipping-in operation. Each fastening piece may, with the aid of a screw, serve for adjusting the orientation of the assembly in a precise direction. The fitting may thus be easily disconnected for any service or maintenance work, especially for changing lamps.

The holes 8 collaborate with the corresponding holes 9 in the closure endpiece 7 so that the assembly, comprising the base section 2, the endpiece 7 and the covers 4, is fastened together by the screws 10.

The holes 20 engage with the studs 19 on the closure endpiece 7. This endpiece, which includes the studs 19 and the holes 9, has a perimeter matching the base section 2 and remains fastened between the latter and the aluminum covers 4. The hole 11 serves for passage of the electric flex 12.

The upper part of the covers 4 allows the plastic section 3 and the aluminum sections 5 to have a length slightly greater than the rest of the elements of the fitting. This takes account of the expansion and contraction phenomenon which, in the case of a fitting 300 cm in length, may be as much as 15 mm for a polycarbonate or an acrylic material.

Thus, the fitting that has just been described is a light fitting, which is virtually unable to deform with variations in temperature, has the possibility of being variable in length in order to achieve a maximum length of 300 cm, has no problems of condensation inside it, is easy to assemble and is very simple for it is to be removed from its support.

What is claimed is:

1. A light fitting, comprising:

a base section having a length direction and a first length in the length direction between first and second ends of the base section, the base section being shaped to define two lateral flanges extending in the length direction, each flange having an upper end; an electrical supply rail in the base section;

first and second closure endpieces respectively at the first and second ends of the base section and the closure endpiece being fastened to the base section, the closure endpieces having respective upper edges;

a transparent section having opposite ends and being of a length between the ends thereof that extends beyond both closure endpieces, the transparent section rests on the upper edges of the closure endpieces and is applied against the two lateral flanges, the transparent section having lateral edges which completely cover and surround the upper ends of the flanges of the base section;

first and second end covers at the opposite ends of the base section and respectively engagable with the first and second ends of the base section and with the transparent section; the end covers being pressed against the respective endpieces and also enclosing the opposite ends of the transparent section and the upper edges of the base section.

2. The light fitting of claim 1, further comprising a respective lateral section which extends in the length direction and covers each one of the lateral edges of the transparent section over the entire length of the transparent section.

3. The light fitting of 2, wherein each lateral section has one edge that terminates in a rounded slideway; a respective rounded slideway in the base section toward the upper ends of the flanges for receiving the rounded slideway of the lateral section for fixing the lateral section over the entire length of the fitting;

each lateral section having a free end away from the rounded slideway which is shaped and positioned to press the transparent section against the upper end of the base section and to hold the transparent section laterally in place.

4. The light fitting of claim 2, wherein the base section and the lateral sections are made of extruded aluminum.

5. The light fitting of claim 2, wherein the transparent section and the lateral sections are each of slightly longer length than the base section; the end covers being placed to leave a free space at each of the ends of the light fitting enabling variations of the length of the transparent section and the lateral sections.

6. The light fitting of claim 2, further comprising a lug on the base section external to the flanges and a groove at the base section and near the lug for receiving a fastening system for the light fitting.

7. The light fitting of claim 1, wherein the transparent section is a plastic section.

8. The light fitting of claim 7, wherein the transparent plastic section is made of transparent polycarbonate.

9. The light fitting of claim 1, wherein the transparent plastic section is made of extruded plastic.

10. The light fitting of claim 1, having a variable length.

11. The light fitting of claim 1, further comprising holes in the base section positioned for enabling water in the base section to drain off.

12. The light fitting of claim 1, wherein at least one of the upper ends of one of the flanges of the base section is inclined in shape for easing the fitting thereon of the transparent section.

13. The light fitting of claim 1, wherein pins position the closure endpieces to the base section, the covers cover the endpieces and screws fasten the covers to the base section.

14. The light fitting of claim 1, further comprising a parabolic reflector inside the base section and inside an area defined by the flanges and the reflector is shaped in order to concentrate light in the base section in one direction.

15. The light fitting of claim 1, further comprising at least one diffusing grid in the fitting, the grid positioned and operable to prevent light from being reflected in selected directions.

* * * * *